United States Patent [19]

McGuffee

[11] Patent Number: 5,018,294

[45] Date of Patent: May 28, 1991

[54] STEADY HAND

[76] Inventor: Dennis McGuffee, 623 Teagarden, Gulfport, Miss. 39507

[21] Appl. No.: 200,539

[22] Filed: May 31, 1988

[51] Int. Cl.[5] ..... F41A 35/00

[52] U.S. Cl. ..... 42/94

[58] Field of Search ..... 42/94

[56] References Cited

U.S. PATENT DOCUMENTS

| | | | |
|---|---|---|---|
| 46,365 | 2/1865 | Kinman | 42/94 |
| 281,338 | 7/1883 | Butler | 42/94 |
| 784,390 | 3/1905 | Dunham | 42/94 |
| 889,658 | 6/1908 | Burnaugh | 42/94 |
| 915,481 | 3/1909 | Roop | 42/94 |
| 1,103,824 | 7/1914 | Page | 42/94 |
| 1,288,684 | 12/1918 | Roe | 42/94 |
| 3,390,477 | 7/1968 | Galbraith | 42/94 |
| 4,575,964 | 3/1986 | Griffin | 42/94 |
| 4,844,390 | 7/1989 | Duke | 42/94 |

*Primary Examiner*—Charles T. Jordan
*Assistant Examiner*—Richard W. Wendtland

[57] ABSTRACT

A rifle support supporting the forearm of the user and designed to attach along the forearm of the user. The design braces the forearm against the thigh or knee of the user. The rifle support is designed so as to fold up to be no longer than the forearm in order that it might be carried on the forearm without interfering with other activities while in use. The brace has two main sections, one held fixed to the forearm and the second bracing the forearm member against the knee. Both members fold together. The second member is of adjustable length to allow the user to adjust the height at which the forearm is held with the one free hand.

5 Claims, 3 Drawing Sheets

STEADY HAND

BACKGROUND OF THE INVENTION

1. Field of Invention

The present invention relates to gun supports.

2. Prior Art

The following U.S. Patents relate to gun rests. None of the patents disclose the concepts presented by the present invention.

| U.S. Pat. No. | Issued to: |
|---|---|
| 4,575,964 | Griffin |
| 3,390,477 | Galbraith |
| 1,288,684 | Roe |
| 1,103,824 | Page |
| 915,481 | Roop |
| 889,658 | Burnaugh |
| 784,390 | Dunham |

The prior art shows several devices designed to relleve fatigue and allow for weapons to be held steady and for long periods of time without fatigue. The prior art designs support the rifle itself or upper arm. Prior art which attached to the body have sections which interfere which casual body movements in order to provide adequate bracing.

Of the patents cited, U.S. Pat. No. 839,658 shows a device supporting the forearm. In so doing, it relies on supports which also support the upper arm and includes a restraining strap around the torso. U.S. Pat. No. 4,575,964 provides for support of a weapon in adjustable form from the knee. U.S. Pat. No. 3,390,477 shows a telescoping arm from the upper arm to the torso.

The present invention improves on the prior art. It supports only the forearm. As with the other patents, the design relieves fatigue. The device supports the forearm as opposed to supporting the weapon or upper arm. The forearm is the major weight bearing member of the left arm since the rifle is actually held by the forearm.

The invention is mainly designed for tree stand hunting. In tree stand hunting, aiming is generally done at a distance of over 100 feet from the target. When aiming at a distance, a small adjustment such as is available by movement of the shoulder, torso or thigh using the invention is sufficient to give a wide target area vertically and horizontally, there are no limits to body motion when using the device. Since no other part of the arm is supported or held in place at the same time, the device is not restrictive when it becomes necessary to change the height of the leg, torso or shoulder to aim.

The device is not attached to the body except at the forearm. By lifting the forearm, the device comes off of or is disengaged from the knee and the weapon may be fired without interference from the device in the event that a rapid change in vertical angle becomes necessary. Such changes may occur when the target moves close to or directly below a hunter in a tree stand.

Because there is no attachment to the upper arm or torso the user has greater flexibility. The device does not restrict any portion of the arm, except the forearm and does not attach fixedly to any part of the body except the forearm, although it may rest on the knee.

Unlike much of the prior art, the device may be released without special movements.

The device may be carried in place against the body by strapping the device to the arm. The brace folds into the forearm support and, due to this design, does not interfere with normal movements or with activities common in hunting such as climbing and walking until the invention is unfolded.

The invention unfolds from the forearm. A single hand is needed to unfold the portion which comes down to the thigh from the forearm. A single hand is necessary to adjust the height at which the forearm supporting member is held above the thigh. The invention unfolds quickly and quietly in an area where movements are restricted due to the unique design.

Since it is held fixed to the forearm, if released, the device remains attached to the forearm preventing it from falling and being lost or damaged.

Because the invention eliminates many of the parts required for body attachment and as the design does not require any individual design changes for different users at the manufacturing level, the invention is easy to fit and inexpensive and simple to produce and repair.

As the device does not lock in place, no shock is transferred by way of the support to any portion of the body.

The principle object of the invention is to provide support for the forearm of the user. Another object is to provide a device which is easily carried set up and released without interfering with typical hunting activities.

Another object is to provide a support which pivotally connects a forearm support to a knee or thigh brace.

Yet another object is to provide a light weight support having little bulk so it may be carried easily with a large amount of other hunting equipment.

Another object is to provide a single adjustable support for different users and for different positions for a given user.

Another object is to have a support fixed to the forearm when in use so that it will not fall or become dislodged by movement of the user while waiting, disengaging the support or firing the weapon.

These and other objects and advantages of the invention will become better understood hereinafter from a consideration of the specification with reference to the accompanying drawings forming part thereof, and in which like numerals correspond to parts throughout the several views of the invention.

BRIEF DESCRIPTION OF THE DRAWINGS

For a further understanding of the nature and objects of the present invention, reference should be had to the following detailed description taken in conjunction with the accompanying drawings in which like parts are given like reference numerals and wherein.

DETAILED DESCRIPTION OF THE PREFERRED EXEMPLARY EMBODIMENT(S)

Figure 1:
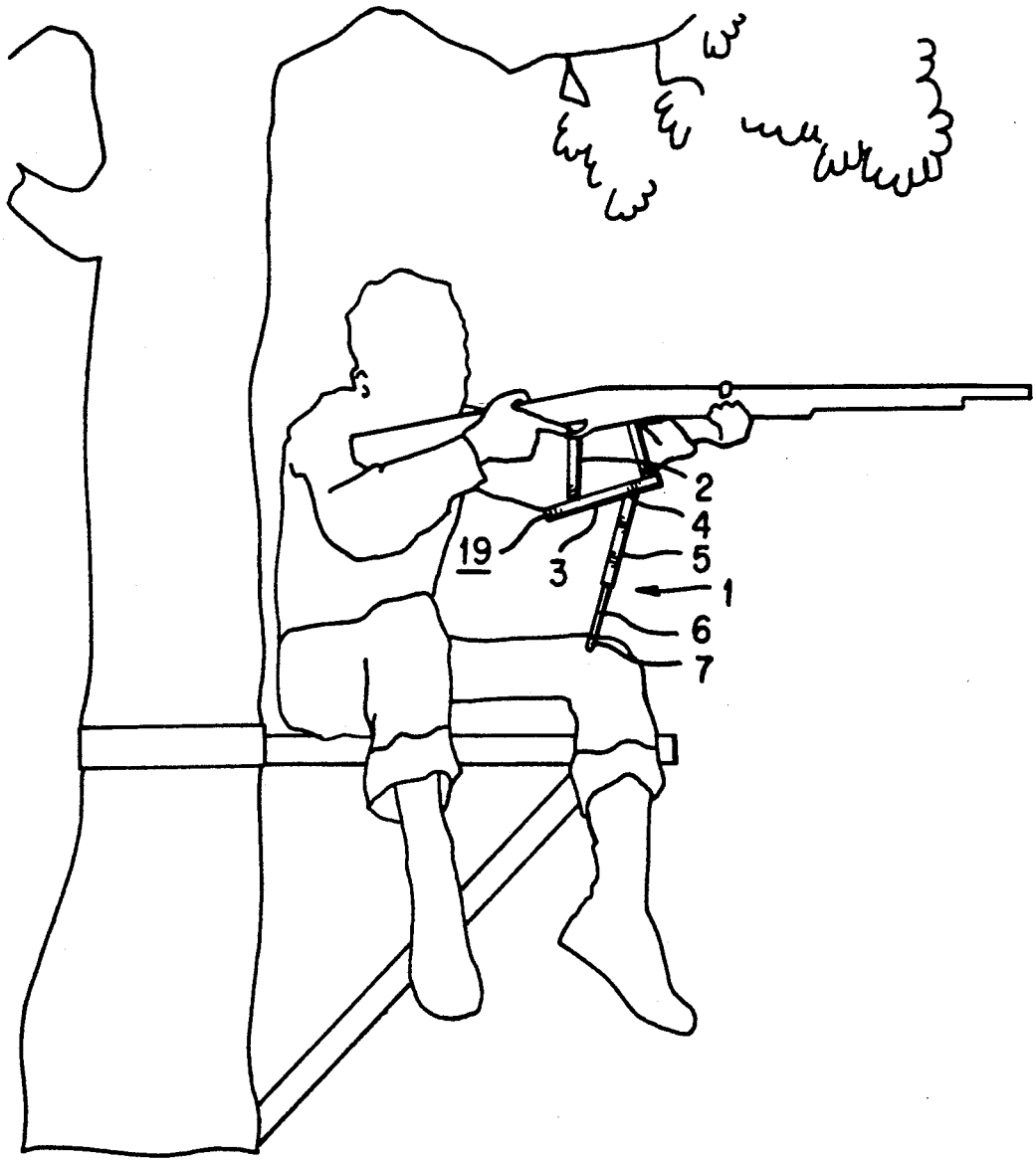
FIG. 1 is a perspective view of the gun support as used in a sitting position in a tree stand or kneeling position.

As can best be seen by reference to FIG. 1, in the preferred embodiment, the arm support 1 is held against the forearm of the user by two velcro straps 2. Velcro straps 2 are permanently bolted to the up side of the forearm brace or support means 3 by rivets 2(*a*).

The forearm brace 3 is sufficiently long and wide to allow for comfortable support of the forearm. The forearm brace may be curved to allow for the arm to rest more comfortably and may be padded for the same purpose without varying from the disclosure of the invention. Straps 2 are placed in front of and behind an anchoring means 4. In the preferred embodiment, anchoring means 4 is a pivot means 4 comprising a bolt, rivet or pin 4(*a*) passing through forearm brace 3 between straps 2 and passing through the upper end of bracing means or knee support 18 so that the knee support may pivot about the pin 4(*a*). The pivot point 4 for knee support 18 is between the two straps 2 to provide better leverage control using the muscles controlling the forearm which is held to the forearm brace 3.

Pivot 4 is desirable as it allows for minor adjustments in the aim of the gun to be made by moving height of the leg, torso or arm. Since the support is mainly used for aiming at a distance, a minor vertical adjustment can yield a large vertical target area.

Knee support 18 is comprised of two parts, a top section 5 and a bottom section 6. Bottom section 6 may be equipped with a base 7 which may be curved and padded to allow it to more comfortably fit against the knee. Base 7 should have a small amount of curve in order to allow base 7 to roll on the knee without coming off as minor body and arm movements are made to change the aim of the rifle.

The top section 5 and bottom section 6 are held together by adjustment means 8 at a height determined by the user. In the preferred embodiment, adjustment means 8 comprises a slot 15 defined in the bottom section 6, a hole 14 defined in the lower portion of top section 5 and a bolt 17 which fits through the hole 14 and slot 15 along its shaft.

The head of bolt 17 is braised or welded to the back of the lower portion of top section 5 after insertion through hole 14, and a wing nut 16 which may be fastened to the end of bolt 17 to hold it securely in place at the desired location along the length of slide 15.

Serrated edges, friction tape or the like may be provided to Insure a tighter fit along the point of contact between top section 5 and bottom section 6. Brazing or otherwise fixing the head of the bolt 17 in place is desirable to allow for the user to tighten and loosen the wing nut 16 to adjust the height and at which top section 5 and bottom section 6 are held together with the one free hand, the other hand being attached to the forearm which is in turn attached to the arm support 3.

For most users a minimum length of 8 inches and a maximum extension of 15 inches is sufficient variation of length for knee support 18.

Figure 3:
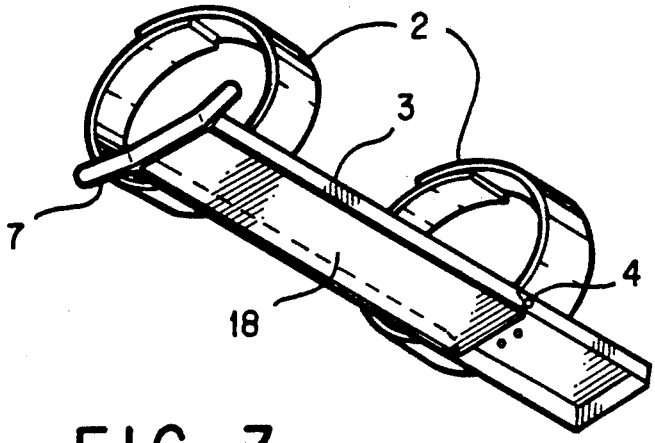
FIG. 3 shows a perspective view of the gun support when folded.
Figure 5:
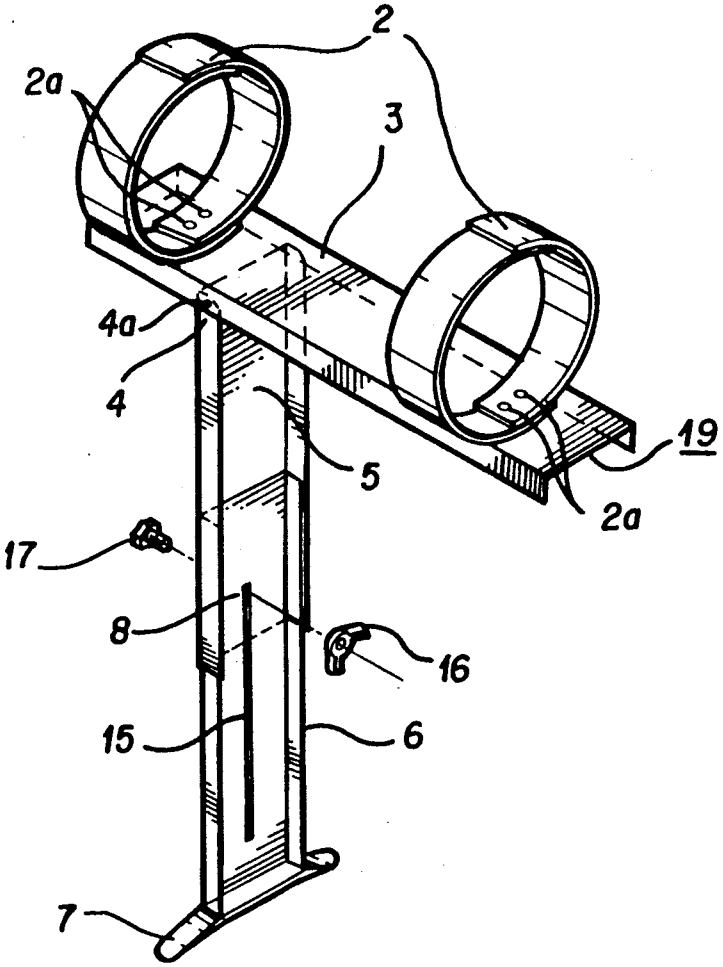
FIG. 5 shows the gun support with the knee brace extended.
Figure 4:
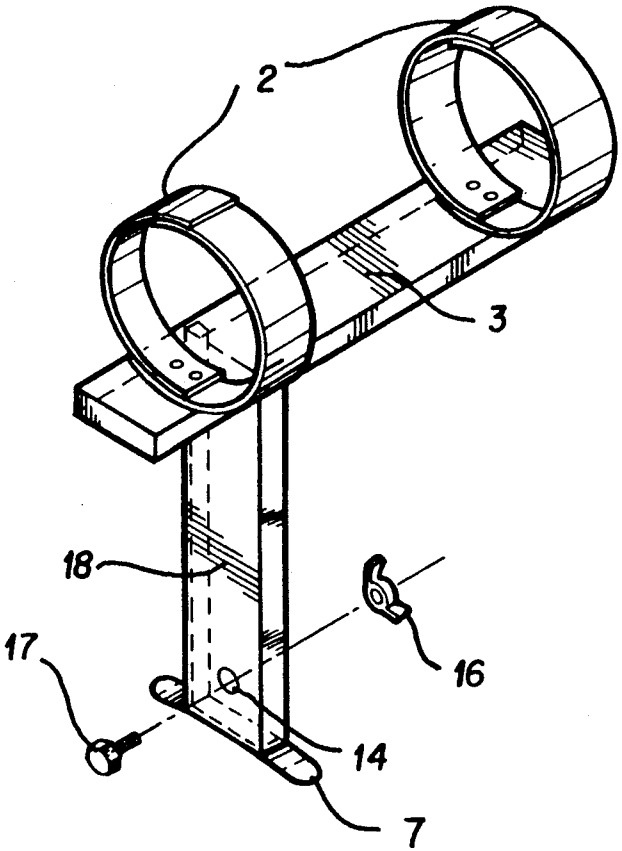
FIG. 4 shows a perspective view of the gun support open or unfolded with the knee brace retracted.

Arm support 3 is shaped to define a cavity and is of greater width than top section 5 and of similar height. In this way, top section 5 may, when folded along pivot point 4 fit as shown in FIG. 3 within the cavity defined by arm support 3. Similarly, top section 5 defines a cavity and is of greater width than bottom section 6 and of similar height. In this way, bottom section 6 may slide into the cavity defined by top section 5 by loosening wing nut 16 and sliding bottom section 6 into top section 5 along the length of slot 15. The length of knee brace 18 when fully retracted is slightly longer than the distance between pivot means 4 and the back end 19 of arm support 3 so that base 7 is clear of the arm support 3 when the device is folded and retracted.

This design provides that wingnut 16 faces the user's torso when the device is attached for easy access to wingnut 16. Arm support 3 also folds back towards to torso so that the section 5 and 6 may be left in adjustment relative to each other when arm support 3 is folded into the hollow defined by arm support 3.

Figure 2:
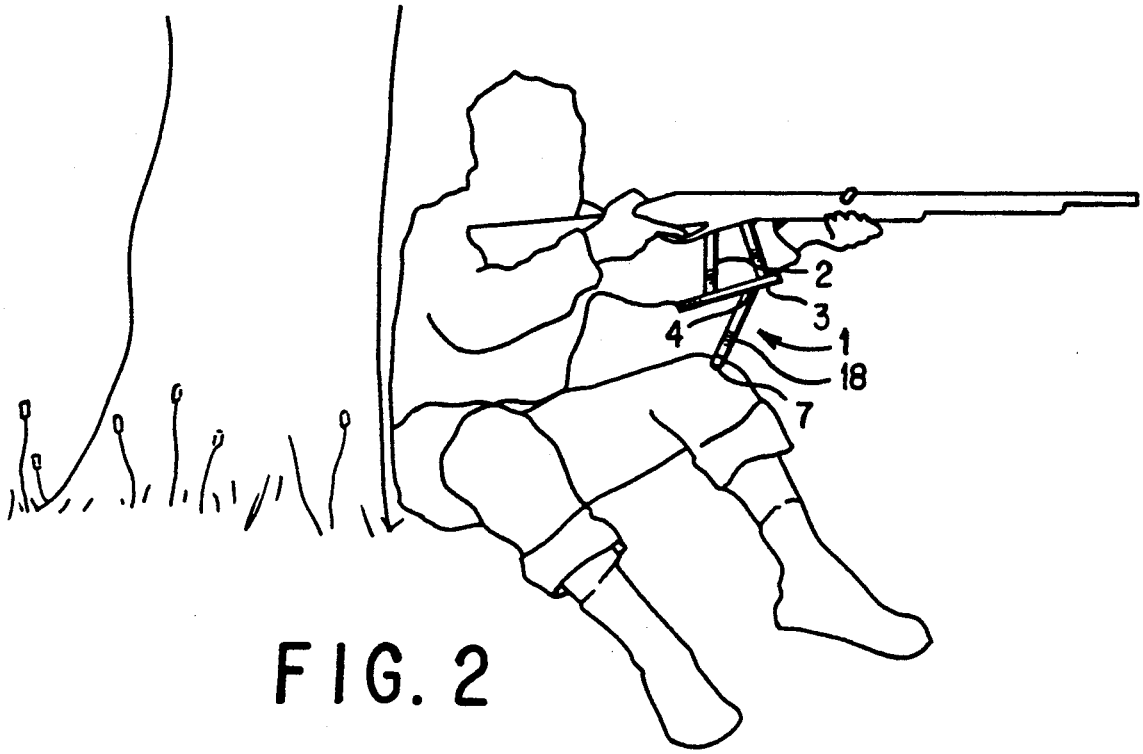
FIG. 2 is a perspective view of the gun support as used in a sitting position without a stand.

Knee brace 18 is adjustable to allow for different users to use the device as well as allowing a single user to vary the height at which the forearm brace is held above the base 7. As can best be seen by reference to FIGS. 1 and 2, the forearm rests on the top of arm support 3. Arm support 3 is held to the arm by straps 2 so that it is steady in place. Straps 2 have a fastening and unfastening means, preferably velcro for easy attachment and release although buckles or the like could be substituted while remaining in the scope of the invention. The straps may be made elastic in order that they more firmly grip the forearm of the user.

The vertical angle of the support varies according to the distribution along pivot 4 by the user. In this way, the angle is easily varied to prevent the user to move his arm to prevent his arm from getting stiff and to allow the user to scan the target area.

It is particularly in line with the improvements shown herein that the body of the user and upper arm are not restricted by the device. Even the forearm of the user is not unduly restricted since by lifting the device, it becomes free of its contact with the knee or leg of the user. Because the height of the knee brace remains adjusted when moved, it may be quickly and easily replaced in position when the user puts the gun down to change his position or to engage in other activities while hunting.

An additional means to secure the angle between arm support 3 and knee brace 18 may be provided to hold the angle of the pivot point 4 in place. This means to secure would allow the user to fix a comfortable angle. Preferably this means would hold the angle loosely fixed with an adjustable amount of drag to allow force from the arm to adjust the angle but hold it sufficiently to prevent the angle from changing when the device is lifted from the knee.

Although the invention may be easily removed, it is rarely necessary while hunting as the device does not interfere. The invention is in place on the forearm and not on the body or upper arm where it would be more likely to interfere with normal activities. If the hunter needs to stand upright or make other major adjustments, the device comes free of its contact with the knee and the forearm to which the invention is attached is free of any constraints from the invention. The invention is light weight, fits in a non-obtrusive position and does not drop when raised above and out of contact with the thigh of the user because of the two velcro straps 2 around the forearm.

The pivot point 4 is located under the forearm which also rests on the fulcrum, arm support 3. The height of the pivot point may be adjusted slightly while the height of knee brace 18 is fixed by moving the heel, knee or leg. Additionally, the direction of fire may be changed by pivoting the body or arm. There are no ratchet joints or fixed joints which prevent this type of motion. A greatly enhanced control of the gun is derived by having the control leveraged by the arm support 3 and the user's arm.

A three way pivot such as a ball joint may be provided at pivot point 4 in order to allow the user to have greater control along the horizontal plane for minor adjustments which can otherwise be made by moving the user's body.

By reducing the number of joints, the pivot joint 4 and adjustable height joint 8, the device is simpler to use and less expensive to manufacture than a similar device with more joints and more complicated adjusting mechanisms. Additionally, the mechanisms used are easily used without instruction, difficult to damage and easy to repair if damaged.

The joints of the device may be spring loaded so that the device automatically retracts when it is released.

Because many varying and different embodiments may be made within the scope of the inventive concept herein taught and because many modifications may be made in the embodiment(s) herein detailed in accordance with the descriptive requirements of the law, it is to be understood that the details herein are to be interpreted as illustrative and not in a limiting sense.

What is claimed is:

1. In a rifle or gun support;

a forearm brace;

a knee support, having a means for attachment movably mounted to the forearm brace and knee support and where the means for attachment is a pivot means to allow the knee support and forearm brace to fold together.

2. In a rifle or gun support:

a forearm brace defining a cavity having a diameter;

a knee support wherein the knee support has a width which is less than the width of the forearm brace cavity so that the knee support may be folded within the cavity defined by the forearm brace;

a means for attachment of the knee support to the forearm brace.

3. In a rifle or gun support:

a forearm brace;

a knee support and wherein the knee support is in frictional contact with the forearm brace when the knee support and forearm brace are folded together so that when folded, the knee support fits within the forearm brace until force is applied to overcome the friction between the knee support and forearm brace;

a means for attachment of the knee support to the forearm brace.

4. In a rifle or gun support:

a forearm brace;

a knee support;

a means for attachment of the knee support to the forearm brace;

a biasing means tending to hold the knee support folded together with the forearm brace.

5. In a rifle or gun support:

(a) a forearm brace;

(b) a knee support comprising;

(i) a top section;

(ii) a bottom section;

(iii) a means for adjustment allowing the bottom section to be adjusted telescopically relative to the top section to adjust the height of the knee support comprising;

(iv) a slot defined by the bottom section (v) a hole defined by the top section;

(vi) a bolt fixedly attached in the hole and fitting through the slot; and (vii) a wingnut attached to the bolt on the side of the slot opposite the hole;

(c) a means for attachment of the knee support to the forearm brace.

* * * * *